US011344076B2

(12) United States Patent
Pereira Lage

(10) Patent No.: US 11,344,076 B2
(45) Date of Patent: May 31, 2022

(54) PHYSIOLOGICAL FOOTWEAR WITH DYNAMIC CONFIGURATION OF MICROPARTICLES APPLIED TO THE INSOLE, AND UNEVEN ARRANGEMENT APPLIED TO THE SHOE SOLE

(71) Applicant: Ana Paula Pereira Lage, Belo Horizonte/MG (BR)

(72) Inventor: Ana Paula Pereira Lage, Belo Horizonte/MG (BR)

( * ) Notice: Subject to any disclaimer, the term of this patent is extended or adjusted under 35 U.S.C. 154(b) by 0 days.

(21) Appl. No.: 16/478,087

(22) PCT Filed: Jul. 17, 2017

(86) PCT No.: PCT/BR2017/000082
§ 371 (c)(1),
(2) Date: Jul. 15, 2019

(87) PCT Pub. No.: WO2018/129599
PCT Pub. Date: Jul. 19, 2018

(65) Prior Publication Data

US 2019/0365019 A1 Dec. 5, 2019

(30) Foreign Application Priority Data

Jan. 13, 2017 (BR) ..... 102017000795
Jul. 5, 2017 (BR) ..... 132017014572

(51) Int. Cl.

| | |
|---|---|
| ***A43B 13/18*** | (2006.01) |
| ***A43B 3/30*** | (2006.01) |
| ***A43B 13/04*** | (2006.01) |
| *A43B 13/41* | (2006.01) |

(Continued)

(52) U.S. Cl.
CPC ..... *A43B 3/30* (2013.01); *A43B 13/04* (2013.01); *A43B 13/18* (2013.01); *A43B 13/41* (2013.01); *A43B 13/42* (2013.01); *A43B 23/02* (2013.01)

(58) Field of Classification Search
CPC ..... A43B 3/30; A43B 13/04; A43B 13/18; A43B 13/41; A43B 13/42; A43B 23/02
See application file for complete search history.

(56) References Cited

U.S. PATENT DOCUMENTS

| | | | |
|---|---|---|---|
| 2,090,881 | A | 8/1937 | Wilson |
| 4,223,456 | A | 9/1980 | Cohen |
| 4,524,529 | A | 6/1985 | Schaefer |

(Continued)

FOREIGN PATENT DOCUMENTS

| | | | |
|---|---|---|---|
| BR | 202012009273 | U2 | 11/2013 |
| CN | 1338233 | A | 3/2002 |

(Continued)

OTHER PUBLICATIONS

Translation of EP 0383685, published Aug. 1990.*

(Continued)

*Primary Examiner* — Ted Kavanaugh
(74) *Attorney, Agent, or Firm* — Bay State IP, LLC

(57) ABSTRACT

The invention pertains to the footwear sector, principally the children's footwear sector, and relates to physiological footwear with dynamic configuration of microparticles used in a chamber between the insole and the sole. The sole has a counter and an irregular arrangement that simulates natural ground.

4 Claims, 5 Drawing Sheets

(51) Int. Cl.
*A43B 13/42* (2006.01)
*A43B 23/02* (2006.01)

(56) References Cited

U.S. PATENT DOCUMENTS

| | | | | |
|---|---|---|---|---|
| 4,658,515 | A * | 4/1987 | Oatman | A43B 17/14 36/2.6 |
| 9,781,974 | B2 | 10/2017 | Reinhardt et al. | |
| 9,788,598 | B2 | 10/2017 | Reinhardt et al. | |
| 9,788,606 | B2 | 10/2017 | Reinhardt et al. | |
| 9,795,186 | B2 | 10/2017 | Reinhardt et al. | |
| 9,820,528 | B2 | 11/2017 | Reinhardt et al. | |
| D833,129 | S * | 11/2018 | Fudalik | D2/954 |
| 2005/0150132 | A1* | 7/2005 | Iannacone | A43B 7/146 36/11.5 |
| 2006/0010717 | A1* | 1/2006 | Finkelstein | A43B 13/188 36/25 R |
| 2008/0060221 | A1* | 3/2008 | Hottinger | A43B 13/187 36/28 |
| 2008/0148605 | A1 | 6/2008 | Edgeworth et al. | |
| 2014/0026438 | A1* | 1/2014 | Cortez | A43B 13/184 36/28 |
| 2018/0289108 | A1* | 10/2018 | Hoffer | A43B 13/125 |
| 2019/0343225 | A1* | 11/2019 | Reddy | A43B 13/42 |

FOREIGN PATENT DOCUMENTS

| | | | | |
|---|---|---|---|---|
| CN | 2574454 | Y | 9/2003 | |
| CN | 2819864 | Y | 9/2006 | |
| CN | 201451598 | U | 5/2010 | |
| CN | 202354511 | U | 8/2012 | |
| CN | 203194703 | U | 9/2013 | |
| CN | 204048236 | U | 12/2014 | |
| CN | 204351160 | U | 5/2015 | |
| DE | 3833231 | C1 | 7/1990 | |
| DE | 102012206094 | A1 | 10/2013 | |
| DE | 102013002519 | A1 | 8/2014 | |
| EP | 0383685 | A1 * | 8/1990 | A43B 13/187 |
| EP | 2786670 | A1 | 10/2014 | |
| JP | 2009195403 | A | 9/2009 | |
| WO | WO2014190402 | A1 | 12/2014 | |

OTHER PUBLICATIONS

Espacenet Bibliography page and corresponding publication showing that prior art No. US20060644005 listed in the specification corresponds to US20080148605, which is listed in this IDS.

* cited by examiner

PHYSIOLOGICAL FOOTWEAR WITH DYNAMIC CONFIGURATION OF MICROPARTICLES APPLIED TO THE INSOLE, AND UNEVEN ARRANGEMENT APPLIED TO THE SHOE SOLE

CROSS-REFERENCE TO RELATED APPLICATIONS AND CLAIM TO PRIORITY

This application is a national stage application of international Application No. PCT/BR2017/000082 filed Jul. 17, 2017, which claims priority to Brazilian Patent Application Nos. 1020170007952 filed Jan. 13, 2017 and 1320170145726 filed Jul. 5, 2017, the disclosures of which are incorporated herein by reference and to which priority is claimed.

FIELD OF THE INVENTION

The invention relates to the field of footwear applied to and principally, but not exclusively, to infants and toddlers, and relates to a physiological footwear with dynamic configuration of microparticles, preferably polymeric or of natural origin, inserted in a chamber located between the insole and the outsole, the outsole having an irregular arrangement and heel counter applied to said outsole simulating the natural ground, a factor that stimulates the activation of the musculature and, consequently, aids with the normal and ideal maturation of the feet.

BACKGROUND AND SUMMARY OF THE INVENTION

The footwear is directed to the development of feet and gait of children, an essential stage in foot development, and the factors that interfere with this development. The invention is the result of testing materials, gait analysis and electromyography of footwear and barefoot babies. In addition, a technique was developed as well as an innovative apparatus for insertion of microparticles described herein.

The technology is based on the concept of ergonomics undertaken by the Economics Research Society apud Iida (2005). Footwear is a product that directly interacts with the human body and represents not only a necessary clothing item, but is also linked to customs and social status. Footwear originates from a study between the relationship of man and his work, equipment, and environment so that knowledge of anatomy, physiology and psychology can be applied in solving problems arising from this relationship.

Basically, footwear is made up of subsets. According to O'Keeffe (1996) and Kohlrausch (2009), the most important basic elements in making footwear is the shoe last, a stylized replica of the human foot that determines the shape of the footwear and how the body weight will be distributed over the foot, two key features for footwear comfort. However, each part mounted on and under the shoe last is subdivided into many other parts, each having very specific features and functions. For this purpose, an anthropometric study on the foot of children from ages 0 to 24 months was carried out to find the measurements of the ideal shoe last for a toddler's foot.

The invention describes a novel technique and arrangement and brings a new shape to the outsole that protects the user's foot, helps with standard foot scrolling as the back of the outsole is raised, and protects the ankle by playing the role of the heel counter thereby preventing torsions. The invention comprises irregularities that simulate the natural ground and, therefore, aids in strengthening muscles and improving balance, and presents high resistance, flexibility, and lightness, providing the user with high comfort, in addition to impact protection.

The dynamic microparticles that forms the comfort insole allows for a greater contact area of the footwear with the foot as the material is molded to the shape of each foot with every step, in addition to providing a greater activation of the muscles of the feet as a result of the dynamic nature thereof, thereby preventing future abnormalities due to poor musculoskeletal development of feet. Further, the material of the upper and the insole allows for sweat absorption.

In the prior art, patents No. PCT/BR2013/000559, U.S. Pat. No. 4,524,539A, DE3833231C2, BR202012009273-0 U2, CN203194703 U, CN201420370638 U, CN201520013085 U, US2006644005 A, JP200839064 A, CN200920073368 U, CN201120401373 U, disclose that the vast majority of footwear is based on simple technologies and intensive labor, or only on subdivisions, that is, on simplified processes that intend to make the product more attractive in terms of price to the detriment of the concern to develop products that solve the ergonomic problem during the foot development stage. This stage is called "maturation of the foot", both in the phase of rapid development phase, that is, in the first six months of independent walking, and in the slow development phase, up to 7 years old.

In short, existing footwear is based on minimal or no ergonomic and anthropometric studies, which may cause abnormalities, such as "flat feet". It can also be noted that, in the current state of the art, most of the insoles are formed by elastomeric materials, such as cut plates or thermoformed materials already in a final shape.

Unlike the pre-existing techniques, the invention presents a product having microparticles injected in a chamber located between the insole and the outsole, which aims to minimize impact when walking, especially to protect the heels, sometimes in addition to minimizing heat, helping correct formation and maturation of feet. The irregular arrangement applied to the outsole extends to the area of the heel, functioning as a heel counter.

The invention presents the following advantages:

- makes the footwear dynamic and irregular, simulating natural ground, which stimulates the musculature,
- aids in the correct and mature development of the foot,
- economical, since it presents competitive cost as compared to footwear currently commercialized, and
- uses materials commonly found on the market for making the microparticles.

BRIEF DESCRIPTION OF THE DRAWINGS

These and other object of the invention is described with reference to its preferred embodiment, shown in the accompanying drawings, in which.

DETAILED DESCRIPTION OF THE PREFERRED EMBODIMENT(S)

Figure 1:
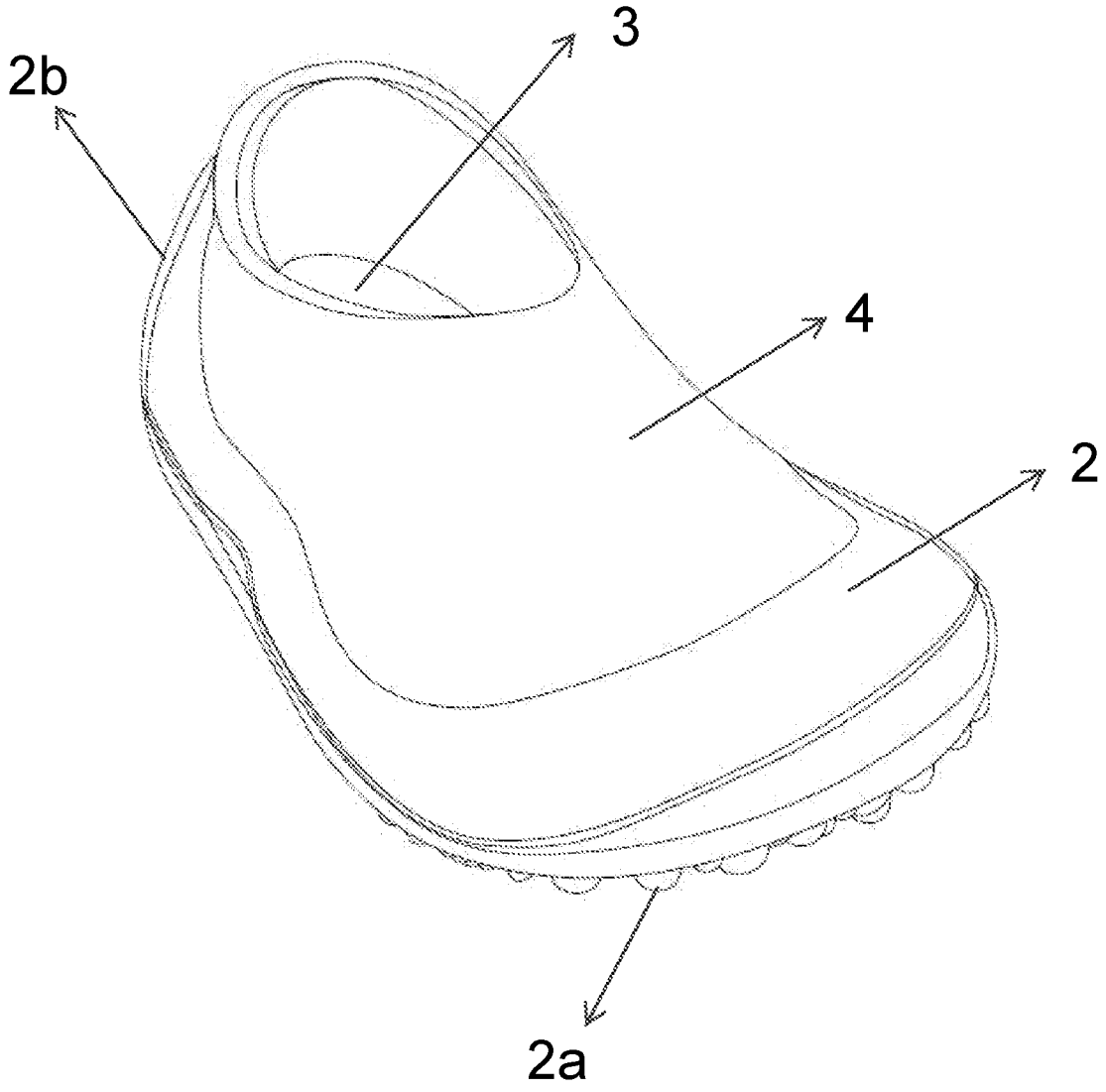
FIG. 1 shows a top perspective view of the footwear.
Figure 2:
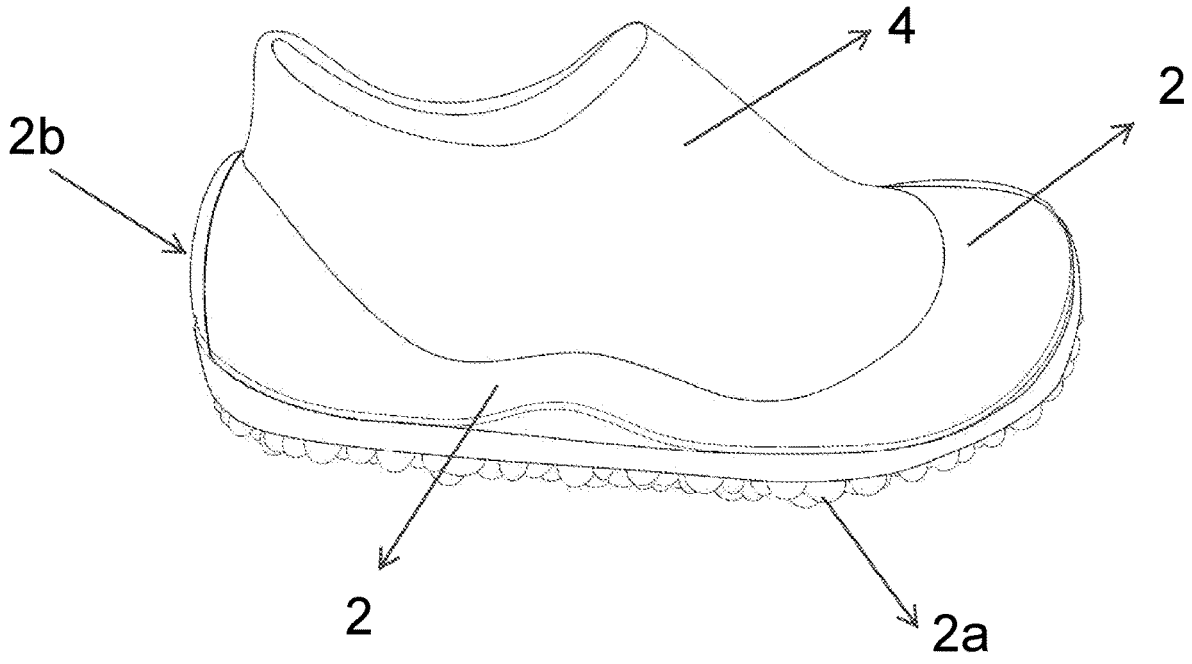
FIG. 2 shows a side view of the footwear.
Figure 3:
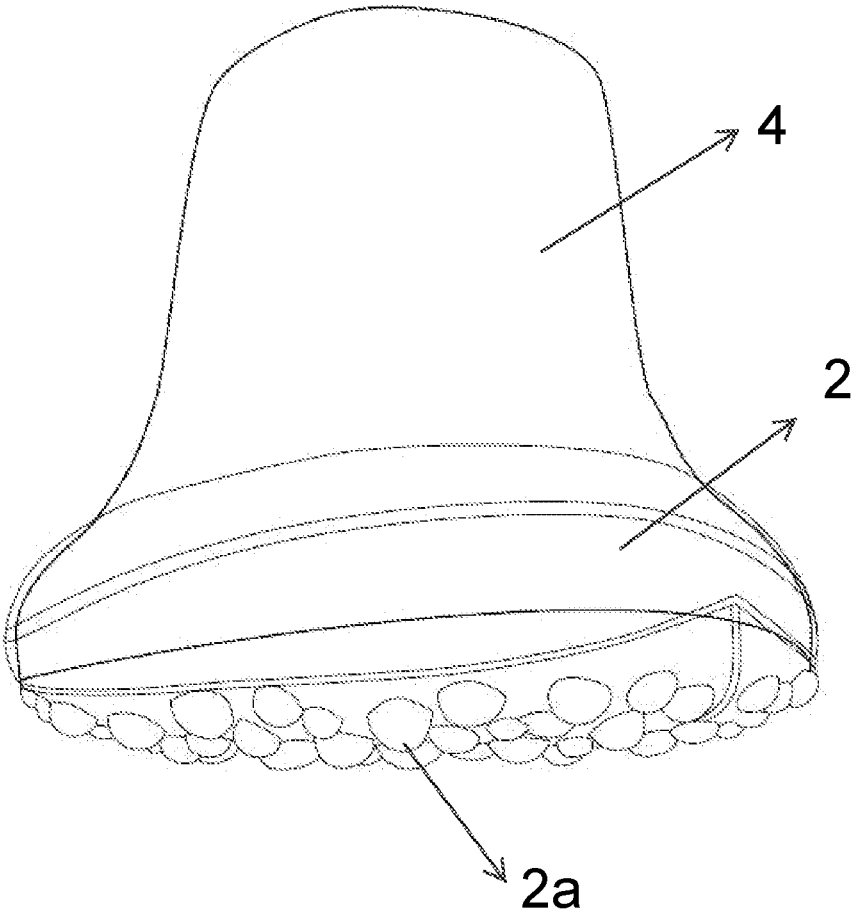
FIG. 3 shows a front view of the footwear.
Figure 4:
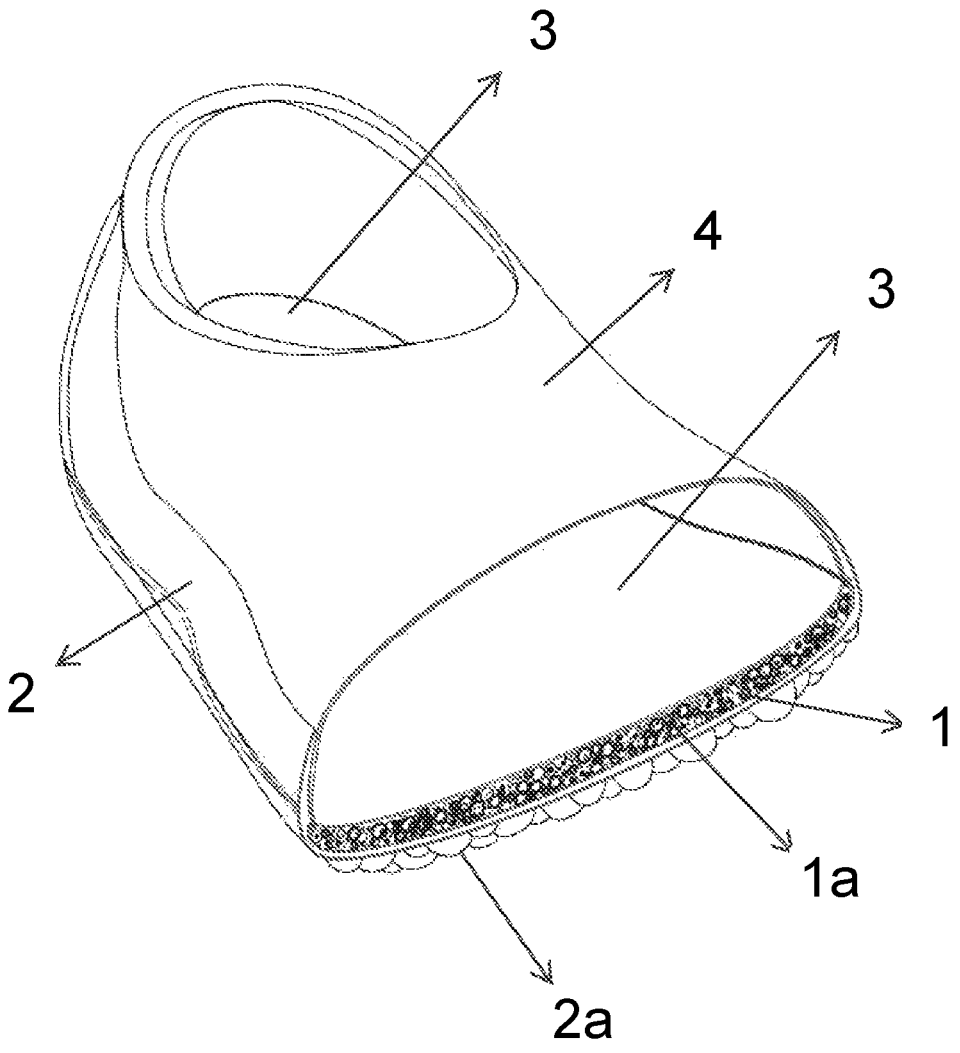
FIG. 4 shows a cross-sectional perspective view of the footwear.
Figure 5:
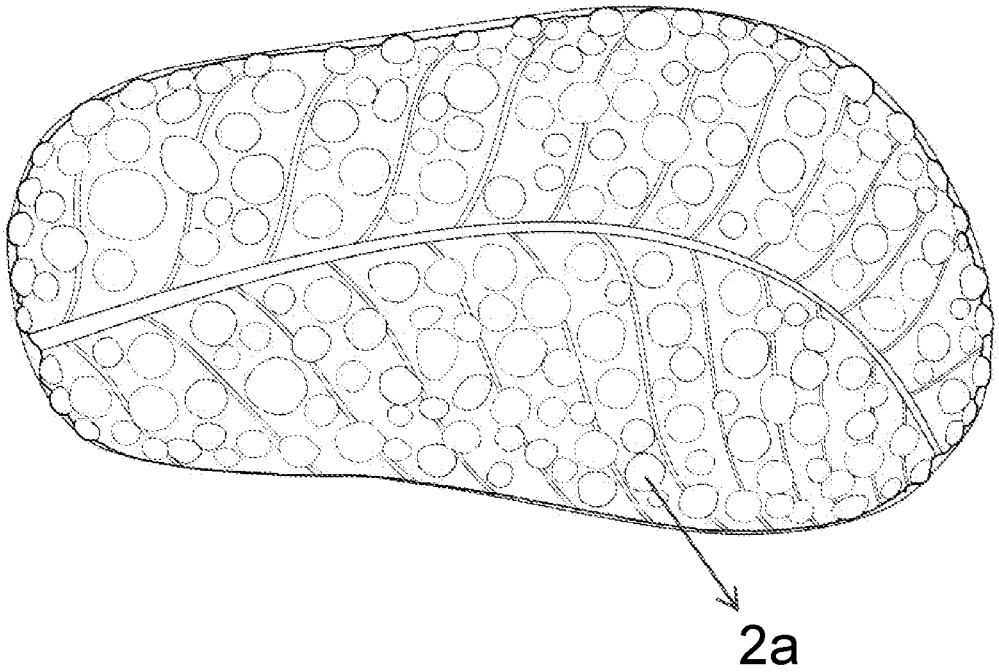
FIG. 5 shows a bottom view of the footwear.

According to FIGS. 1 to 5, the footwear comprises a comfort insole (1) composed of loose and dynamic microparticles (1*a*) applied in a chamber between the insole (3) and the outsole (2) consisting of polymers, preferably polyethylene (PE) and polystyrene (PS). The footwear presents an outsole (2) with uneven semispherical protrusions (2*a*) and with irregular arrangement and a heel counter (2*b*) making the footwear dynamic and irregular, a factor that simulates the user's gait on natural ground, providing stimulation and activation of the musculature of the feet, thereby assisting in their natural and ideal formation, the upper (4) being of varied shape.

The invention claimed is:

1. Physiological footwear comprising:

a closed upper;

an insole; and a polymeric outsole comprising an irregular arrangement, said polymeric outsole extending up and about a heel area of the upper to function as a heel counter;

wherein the polymeric outsole is laterally attached to a surrounding of the upper forming a chamber between the insole and the polymeric outsole wherein the chamber spans a length of the insole and comprises spherical and loose microparticles that create a comfort insole that is configured to mold to the shape of each wearer's foot with every step taken.

2. The physiological footwear according to claim 1, wherein the comfort insole consists of spherical and loose microparticles.

3. The physiological footwear according to claim 1, wherein the microparticles are comprised of polyethylene (PE) and polystyrene (PS).

4. The physiological footwear according to claim 1, wherein the polymeric outsole comprises uneven semispherical protrusions.

* * * * *